US010673118B2

(12) United States Patent
Fraysse et al.

(10) Patent No.: US 10,673,118 B2
(45) Date of Patent: Jun. 2, 2020

(54) POWER DIVIDER FOR AN ANTENNA COMPRISING FOUR IDENTICAL ORTHOMODE TRANSDUCERS

(71) Applicant: THALES, Courbevoie (FR)

(72) Inventors: Jean-Philippe Fraysse, Toulouse (FR); Hervé Legay, Plaisance du Touch (FR); Ségolène Tubau, Toulouse (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 16/130,844

(22) Filed: Sep. 13, 2018

(65) Prior Publication Data

US 2019/0097296 A1 Mar. 28, 2019

(30) Foreign Application Priority Data

Sep. 28, 2017 (FR) ..... 17 00993

(51) Int. Cl.

| | |
|---|---|
| ***H01P 5/16*** | (2006.01) |
| ***H01P 3/08*** | (2006.01) |
| ***H01Q 21/24*** | (2006.01) |
| ***H01P 1/161*** | (2006.01) |
| ***H01Q 13/02*** | (2006.01) |
| ***H01P 5/12*** | (2006.01) |

(52) U.S. Cl.

CPC ..... *H01P 5/16* (2013.01); *H01P 1/161* (2013.01); *H01P 3/081* (2013.01); *H01P 5/12* (2013.01); *H01Q 13/02* (2013.01); *H01Q 21/245* (2013.01)

(58) Field of Classification Search

CPC . H01P 5/16; H01P 1/161; H01P 3/081; H01Q 13/02; H01Q 21/245

See application file for complete search history.

(56) References Cited

U.S. PATENT DOCUMENTS 7,397,323 B2 * 7/2008 Tavassoli Hozouri ..... H01P 1/161 333/117

8,816,930 B2 * 8/2014 Fonseca ..... H01P 1/161 333/137

(Continued)

FOREIGN PATENT DOCUMENTS

EP 1 930 982 A1 6/2008

EP 2 869 400 A1 5/2015

(Continued)

*Primary Examiner* — Robert J Pascal

*Assistant Examiner* — Kimberly E Glenn

(74) *Attorney, Agent, or Firm* — Baker & Hostetler LLP

(57) ABSTRACT

A compact bipolarization is provided power dividers for a radiofrequency power source. The divider according to the invention includes four identical orthomode transducers, eight identical waveguides, each waveguide comprising two bends, four identical T-shaped junctions, four identical twists and two power distributors; the four orthomode transducers being of parallelepipedal shape with a square base, each transducer comprising, on each of two adjacent lateral faces, a waveguide connected to the lower face of the transducer; the four transducers being positioned so as to form a square, each transducer being connected to two junctions that are perpendicular to one another, the set of four junctions forming a Greek cross; each pair of junctions that are situated in one and the same plane being connected, by way of two twists, to the two outputs of a power distributor comprising a single input.

11 Claims, 7 Drawing Sheets

(56) References Cited

U.S. PATENT DOCUMENTS

| | | | | |
|---|---|---|---|---|
| 10,381,699 | B2 * | 8/2019 | Fraysse | H01P 3/12 |
| 2014/0266934 | A1 * | 9/2014 | Cook | H01Q 1/44 343/720 |

FOREIGN PATENT DOCUMENTS

| | | | |
|---|---|---|---|
| EP | 3 179 551 | A1 | 6/2017 |
| FR | 2 582 865 | A1 | 12/1986 |
| FR | 3 012 917 | A1 | 5/2015 |
| WO | 2014/127420 | A1 | 8/2014 |

* cited by examiner

POWER DIVIDER FOR AN ANTENNA COMPRISING FOUR IDENTICAL ORTHOMODE TRANSDUCERS

CROSS-REFERENCE TO RELATED APPLICATIONS

This application claims priority to foreign French patent application No. FR 1700993, filed on Sep. 28, 2017, the disclosure of which is incorporated by reference in its entirety.

FIELD OF THE INVENTION

The field of the invention is that of compact bipolarization power dividers. This type of divider is used to supply power to an array of radiating elements from a source emitting in the radiofrequency domain. It may also operate as a receiver in the same frequency domain. In this case, the divider combines a plurality of signals received by the array into a single signal.

The invention applies more particularly to the following domains:

- active antennae in the X band, in the Ku band and in the Ka band;
- multibeam focal-plane array antennae operating in the low frequency bands and more particularly in the domain of telecommunications in the C band, in the L band and in the S band;
- radiating elements for array antennae;
- space antennae with global coverage, in particular in the C band.

The main missions targeted are active antennae in the X band, in the Ku band and in the Ka band for which the concepts of bulk and surface efficiency are paramount.

BACKGROUND

The apertures of the radiating elements for these missions are of the order of 2.5 to 3.5 times the emission wavelength. This means that the use of cones having high surface efficiencies for these applications should be avoided, given their bulk at these radiating aperture sizes.

One alternative solution is to create an array of metal radiating elements having smaller apertures in order to take advantage of their small heights and of their very high surface efficiencies. To this end, it is then necessary to produce a power divider that supplies the access points of these metal elements in phase and with low losses. This divider has to be compact so as not to modify the gain in compactness afforded by using sources having smaller apertures.

Moreover, according to needs, this divider must also be able to operate:

- in bipolarization with isolation between the two polarizations of greater than 20 dB;
- over relatively large frequency ranges;
- in circular polarization;
- at moderate or high power levels.

The use of propagation lines on a PCB, an acronym for Printed Circuit Board, of microstrip or strip line type is an appealing option for obtaining a highly compact divider. However, this approach is handicapped by the transmission losses that it causes and the low power levels that it allows.

The option of using metal guides, for its part, allows transmission losses to be minimized and high power levels to be supported. However, for its part, it is penalized by the bulk of the metal guides. Divider architectures have been proposed for obtaining compact dividers with this technology. French patent FR 3 012 917, entitled 'Répartiteur de puissance compact bipolarisation, réseau de plusieurs répartiteurs, élément rayonnant compact et antenne plane comportant un tel répartiteur' (Compact bipolarization power divider, array of a plurality of dividers, compact radiating element and plane antenna comprising such a divider) describes a dual-polarization plane power divider comprising at least four asymmetrical orthomode transducers, known as OMT, linked in an array and able to be coupled in-phase to a dual orthogonal polarization power source by way of two power distributors connected perpendicularly to one another. In another configuration, the excitation assembly is formed of a single symmetrical OMT connected to two dividers each having two output ports arranged such that the difference in electrical length between the two outputs is equal to a half wavelength of the emission signal.

These various solutions make it possible to achieve compact devices operating in bipolarization, in spite of the use of metal guides. However, their bandwidths are not enough to address the wide bandwidths required for the active antenna applications of telecommunications satellites in the Ku band and in the Ka band.

SUMMARY OF THE INVENTION

The power divider according to the invention does not exhibit these drawbacks and allows larger bandwidths to be achieved. It comprises four identical OMTs linked to two power distributors. More precisely, the subject of the invention is a compact bipolarization power divider for a dual orthogonal polarization radiofrequency power source emitting at a useful wavelength, said divider comprising four orthomode transducers, characterized in that the divider comprises:

- eight identical waveguides, each waveguide comprising two bends and four identical T-shaped junctions, the four orthomode transducers all being identical and of substantially parallelepipedal shape with a square base, each transducer comprising a lower face and an upper emission face and four lateral faces, each transducer comprising, on each of two adjacent lateral faces, a waveguide connected to the lower face of the transducer;
- the four transducers being positioned so as to form a square, each transducer being connected to two junctions that are perpendicular to one another, each junction being connected by its two branches of the T to the tops of two waveguides, the set of four junctions forming a Greek cross centred on the square of the transducers.

Advantageously, the divider comprises four identical twists and two power distributors, each pair of junctions that are situated in one and the same plane being connected by the base of said junctions, by way of two twists, to the two outputs of a power distributor comprising a single input.

Advantageously, the divider comprises a coupler of which the input is intended to be linked to the radiofrequency power source and the two outputs that are perpendicular to one another being linked to the inputs of the two power distributors, said divider thus formed being able to generate circularly polarized signals.

Advantageously, the coupler is a top-wall coupler or a Riblet coupler.

Advantageously, each power distributor comprises an input, bent at 180 degrees, linked to two identical transverse branches, each branch being terminated by a 90-degree bend linked to an output, such that an input signal propagating in a given direction is separated into two identical output signals propagating in two directions that are parallel to one another and perpendicular to the given direction.

Advantageously, the divider comprises at least one rejection filter.

Advantageously, each twist comprises an enclosure in the shape of a flat quarter-cylinder, an input bent at 90 degrees and an output bent at 90 degrees, the two bends being positioned head to tail.

Advantageously, the side of the square base of each orthomode transducer is around 0.75 times the useful wavelength, and the height of each orthomode transducer is around 0.37 times the useful wavelength.

Advantageously, the side of the square base of the divider is around 2.24 times the useful wavelength, and the total height of the divider is around 0.8 times the useful wavelength.

Advantageously, the frequency associated with the useful wavelength is between 1 and 40 GHz. More precisely, the frequency associated with the useful wavelength is between 10.7 and 12.75 GHz or between 17.2 and 20.2 GHz.

BRIEF DESCRIPTION OF THE DRAWINGS

The invention will be better understood and other advantages will become apparent on reading the following description, which is given by way of nonlimiting example, and by virtue of the appended figures, all shown in a reference frame (x, y, z), in which.

DETAILED DESCRIPTION

In the following text, the transducer operates in transmit mode. Of course, the same transducer may operate in receive mode.

Figure 1:
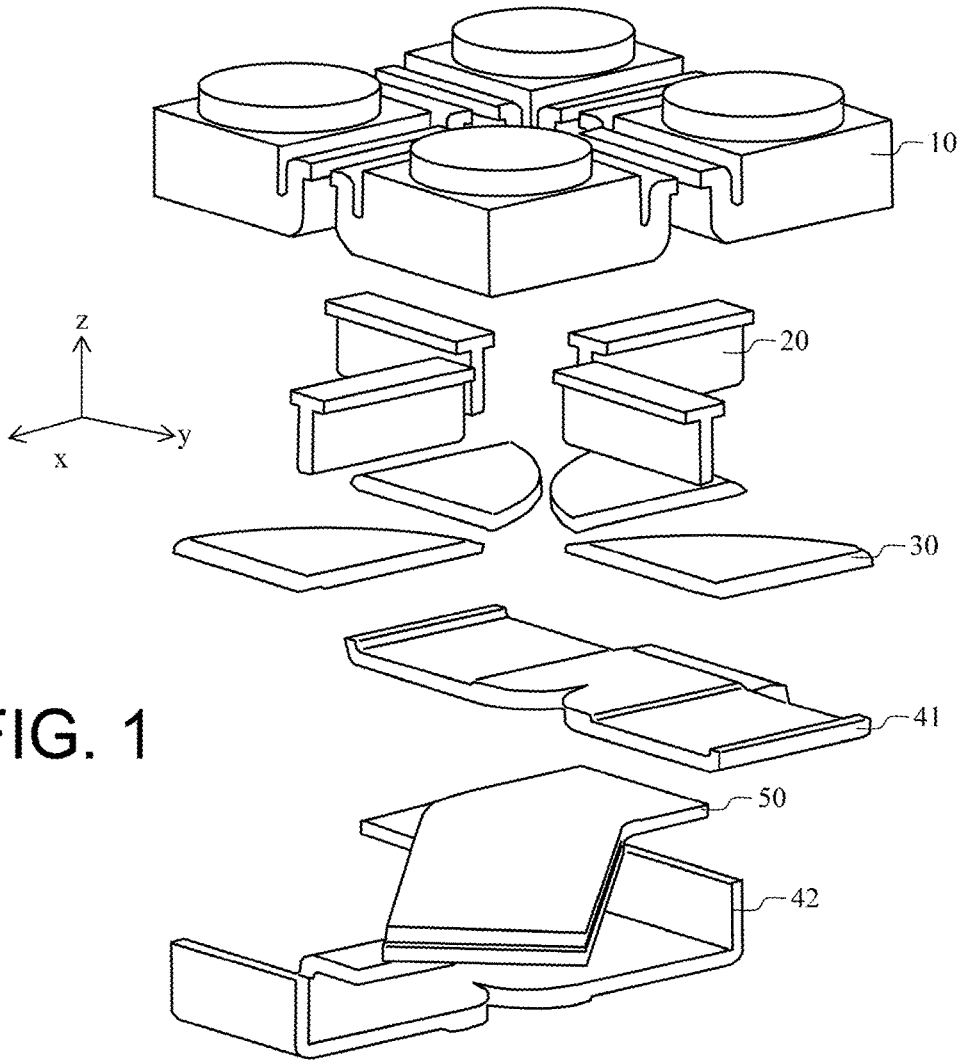
FIG. 1 shows an exploded three-dimensional view of a first configuration of a divider according to the invention.

FIG. 1 shows an exploded three-dimensional view of a first configuration of the divider according to the invention. This first configuration comprises a coupler of top-wall type. This view is oriented in a plane (x, y, z). This divider comprises a plurality of stacked stages.

The last stage is the emission stage. It comprises four identical metal orthomode transducers 10 of substantially parallelepipedal shape with a square base, each transducer comprising a lower face 12 and an upper emission face 11 and four lateral faces 13, all defining a cavity. By way of example, the side of the square base of each orthomode transducer is around 0.75 times the useful wavelength, and the height of each orthomode transducer is around 0.37 times the useful wavelength. Each transducer may comprise a central matching element in the shape of a cone or of a pyramid or in the shape of stacked cylinders of various diameters or of stacked parallelepipeds having square bases of various surface areas. The function of these elements is to improve the matching of the transducer to a given operating frequency band and to improve isolation between two polarizations.

Figure 2:
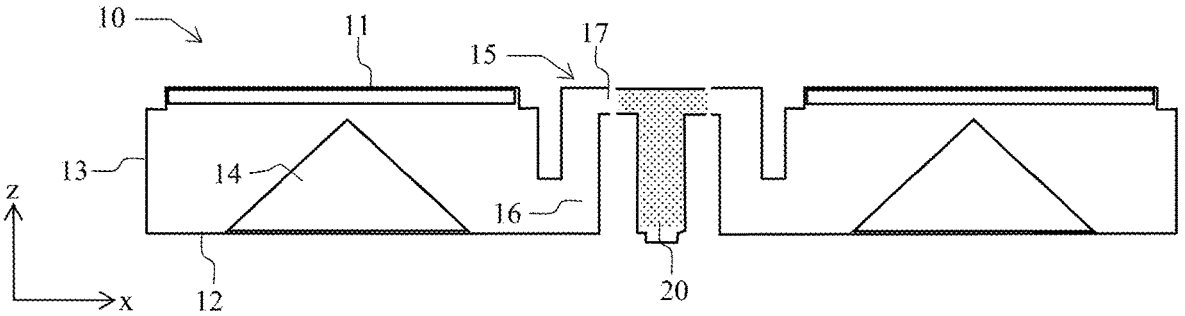
FIG. 2 shows a sectional view of two adjacent orthomode transducers and of the T-shaped junction that links them.

As seen in the sectional view of FIG. 2 formed in a plane (x, y), each transducer comprises, on each of two adjacent lateral faces, a metal waveguide 15 connected to the lower face of the transducer, the output of said waveguide being produced by the top of the transducer. Each waveguide therefore comprises two bends that are separated by a plane guide, a first 90-degree bend 16 linked to the lower face of the transducer, a second 90-degree bend 17 situated at the top of the transducer. The height of a waveguide is close to that of a transducer.

Figure 3:
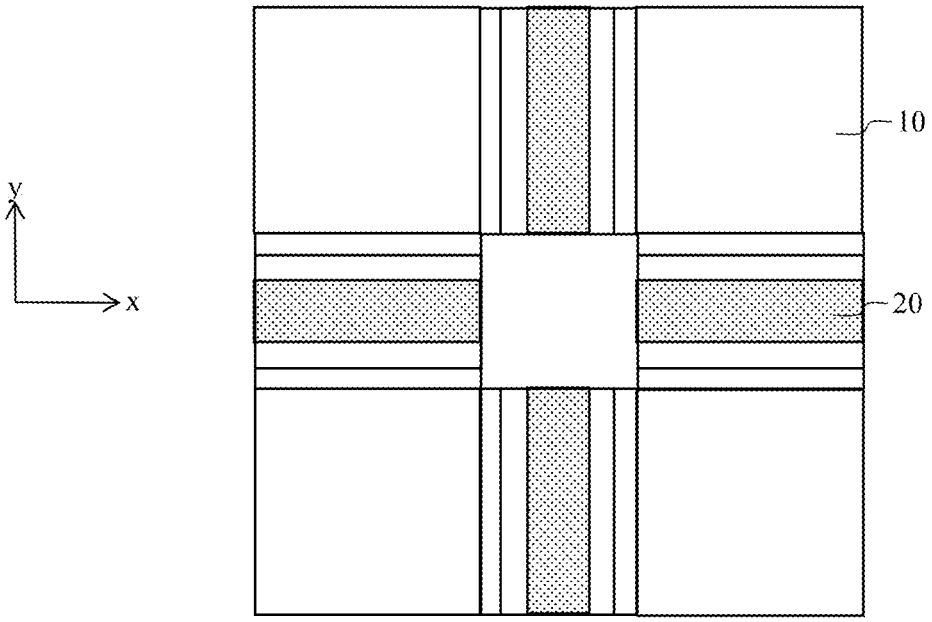
FIG. 3 shows a plan view of the four orthomode transducers of the divider.

As seen in FIG. 3, the four transducers are positioned so as to form a square. Each transducer is connected to its two neighbours by two T-shaped junctions 20 that are perpendicular to one another, each junction being connected by the two branches of the T to the tops of two waveguides, the set of four junctions forming a Greek cross centred on the square of the transducers, as seen in FIG. 3. Two junctions are positioned along the x-axis and two junctions are positioned along the y-axis in this figure. The junctions are what are known as 'E-plane' junctions. The bases of the junctions are level with the bases of the orthomode transducers, as seen in FIG. 2.

Figure 4:
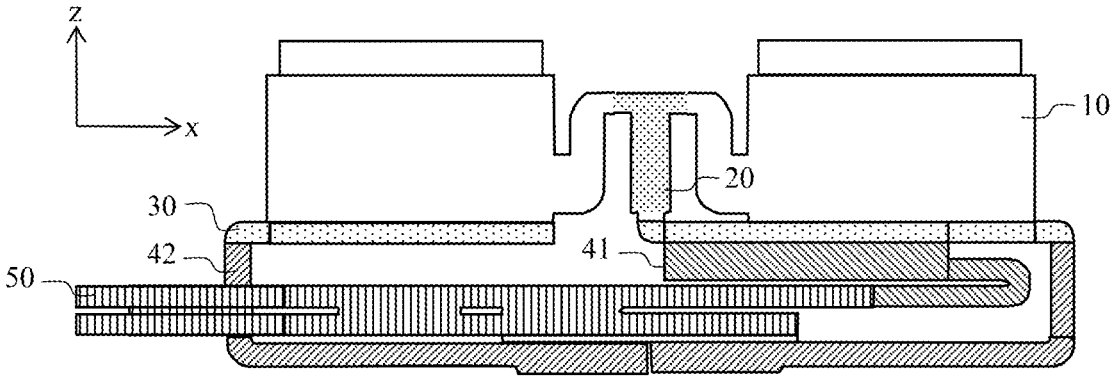
FIG. 4 shows a sectional view of the divider according to the invention.

The stage positioned underneath the upper stage of the divider is shown in the sectional view of FIG. 4. Its function is to facilitate the injection of the emission signals into the four junctions. Specifically, when positioned in a cross, it is not convenient to inject in-phase emission signals into the junctions. This stage comprises four identical twists 30, two power distributors 41 and 42 and the coupler 50. These various elements are shown by different shading in FIG. 4.

Figure 5:
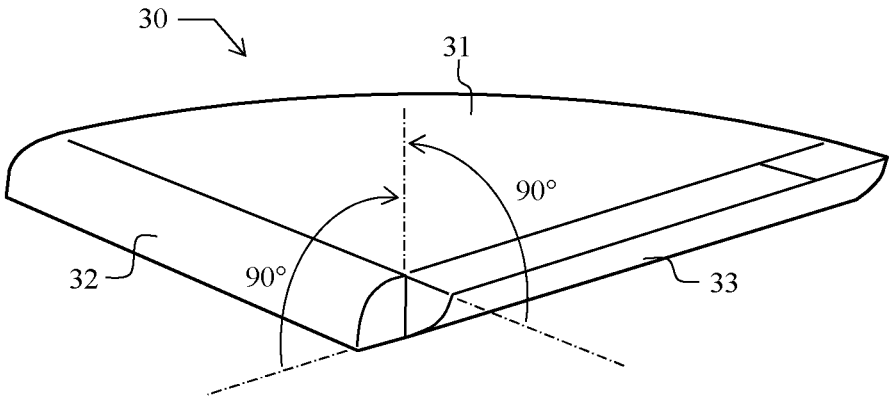
FIG. 5 shows a three-dimensional view of a twist according to the invention.

FIG. 5 shows a three-dimensional view of a twist 30 according to the invention. Each twist 30 comprises an enclosure 31 in the shape of a flat quarter-cylinder, an input 32 bent at 90 degrees and an output 33 bent at 90 degrees, the two bends being positioned head to tail. Thus, with this configuration, the four inputs for the emission signals at the input of the twists are positioned on the sides of the large square formed by the four orthomode transducers so as to form two pairs of two inputs that are orthogonal to one another.

Figure 1B:
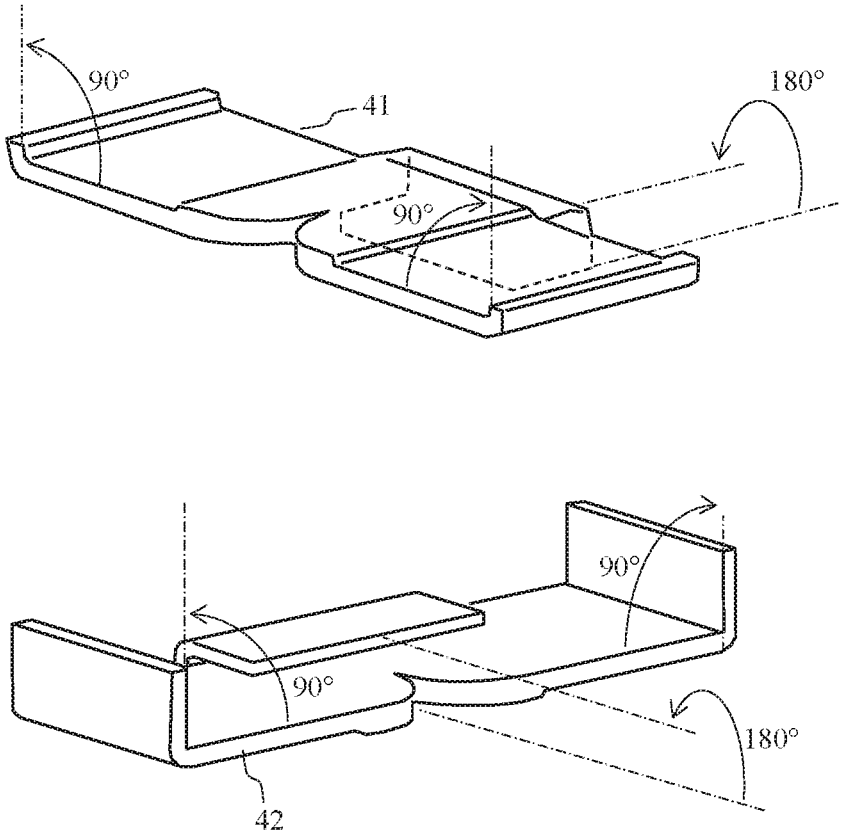
FIG. 1*b* shows three-dimensional views of power distributors of the divider.

These two input pairs are linked to two power distributors 41 and 42, as shown in FIG. 1*b*. Each power distributor comprises an input, bent at 180 degrees, linked to two identical transverse branches, each branch being terminated by a 90-degree bend linked to an output, such that an input signal propagating in a given direction is separated into two identical output signals propagating in two directions that are parallel to one another and perpendicular to the given direction.

Figure 6:
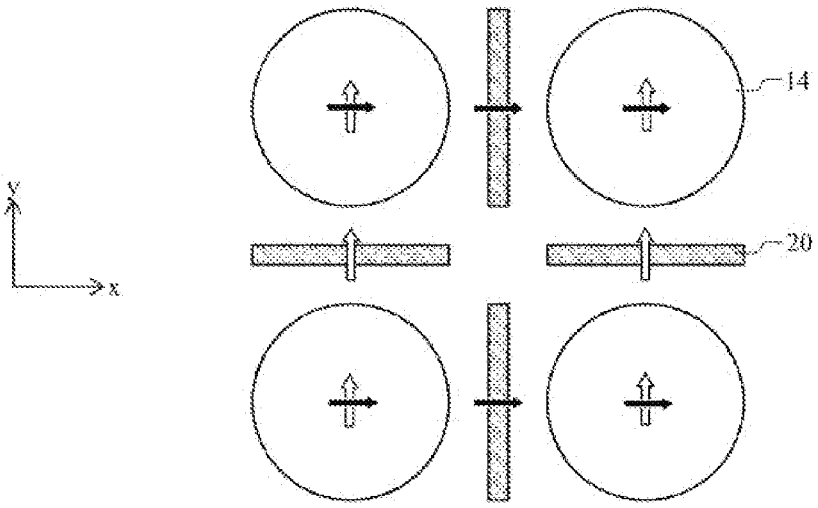
FIG. 6 shows a plan view of the propagation of the polarization of the signals in the four transducers.

From the input of the power distributors to the eight outputs of the four orthomode transducers, the paths taken by the emission signals are perfectly identical. Thus, if a signal is sent on the input of one of the distributors, the four orthomode transducers emit four in-phase signals with the same polarization. On the opposite input of the second distributor, the same property is seen, with the difference that the output signals have a linear polarization positioned at 90 degrees to the previous one. All of these signals are also in-phase. FIG. 6 shows a plan view of the propagation of the linear polarization of the signals in the four transducers 10. The signals coming from the first distributor are shown by white arrows, and the signals coming from the second distributor are shown by black arrows.

Thus, if the divider comprises a flat top-wall coupler 50 of which the input is linked to the radiofrequency power source and the two outputs that are perpendicular to one another are linked to the inputs of the two power distributors, said divider thus formed is able to generate circularly polarized signals.

Figure 7:
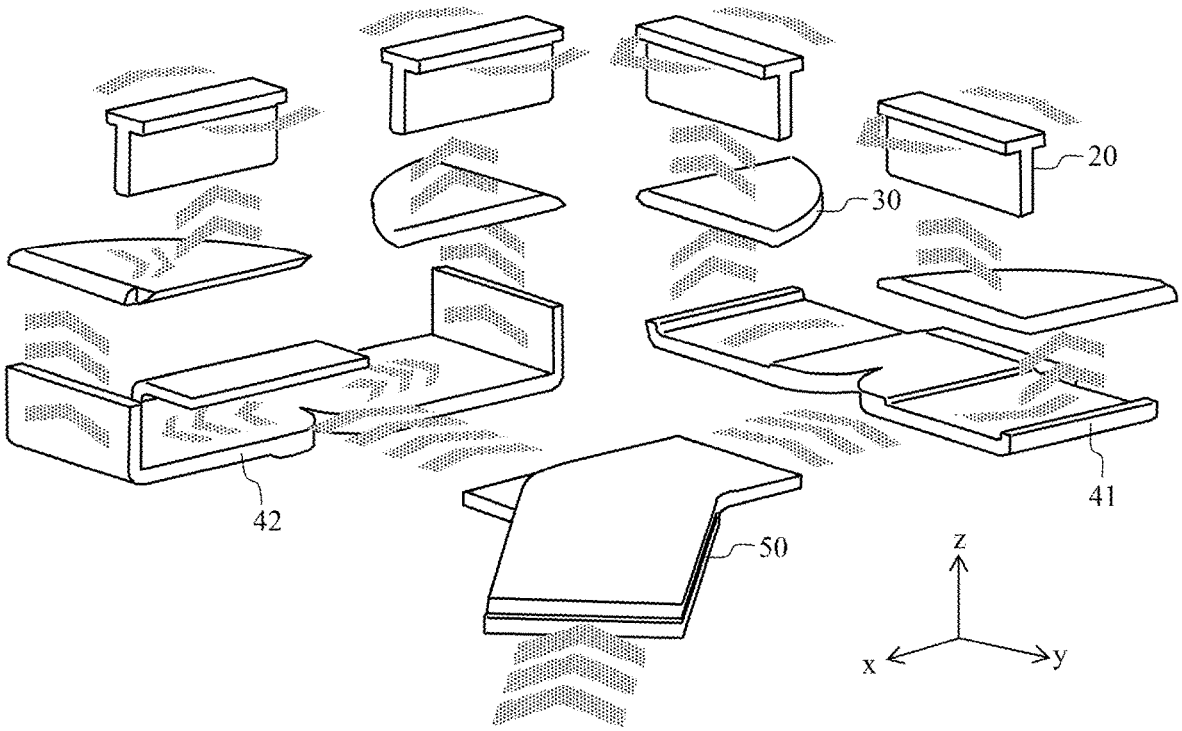
FIG. 7 shows an exploded three-dimensional view of the propagation of the signals inside the divider to the orthomode transducers, which are not shown.

FIG. 7 shows an exploded partial view of such a divider in the reference frame (x, y, z). In this view, the orthomode transducers are not shown. The propagation of the signal through the various components 20, 30, 41, 42 and 50 of the divider is shown by grey chevrons.

By way of nonlimiting example, a divider according to the invention has the following dimensions:

side of the square base of the divider: around 2.24 times the useful wavelength;

total height of the divider: around 0.8 times the useful wavelength.

Figure 8:
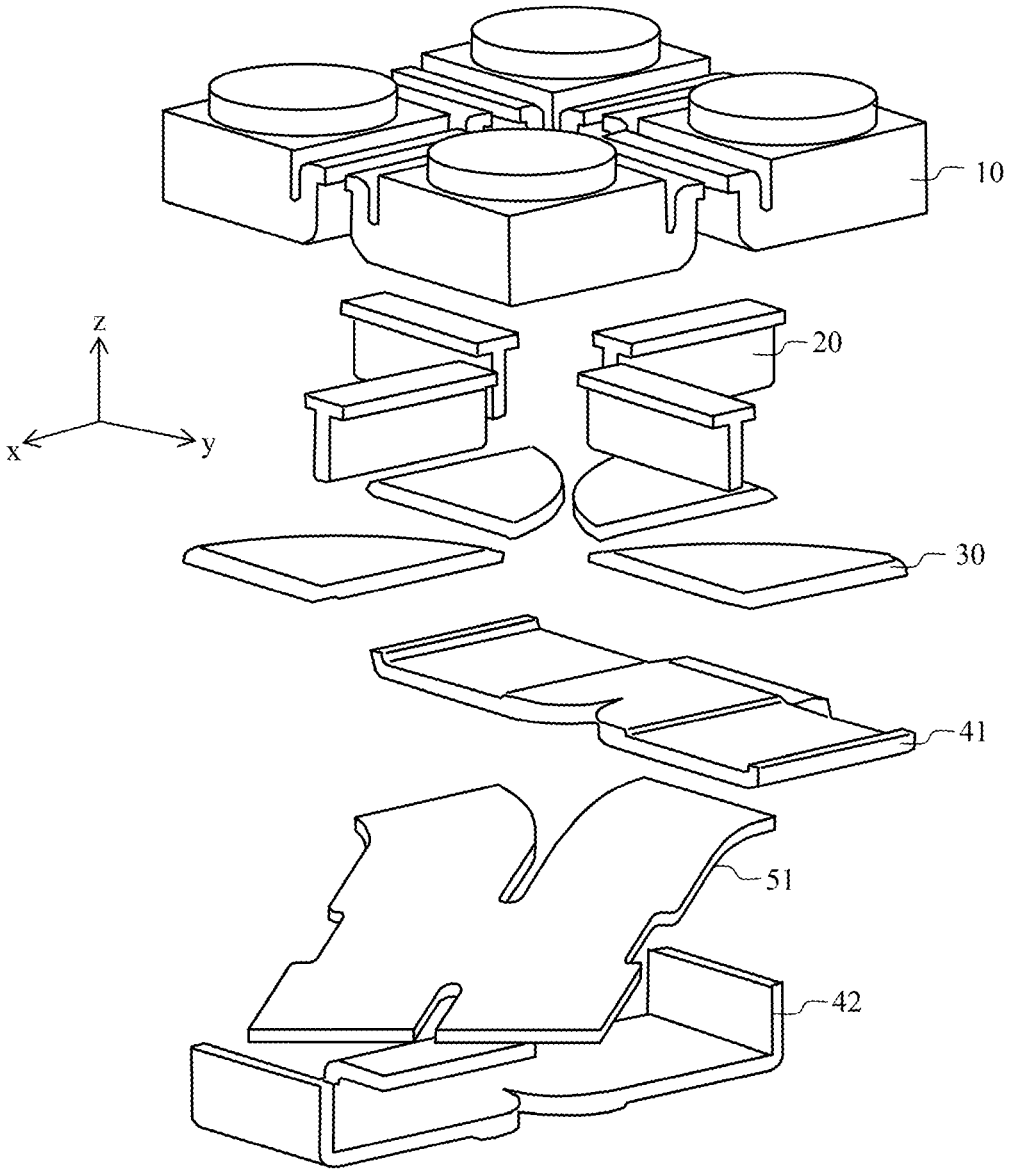
FIG. 8 shows an exploded three-dimensional view of a second configuration of a divider according to the invention.

FIG. 8 shows a second configuration of the divider according to the invention. In this second configuration, the top-wall coupler is replaced by a Riblet coupler 51. As seen in FIG. 8, this coupler comprises two inputs and two outputs. A signal injected onto one of the two inputs is divided on the two outputs into two components of the same level but that are phase offset by 90°.

Figure 9:
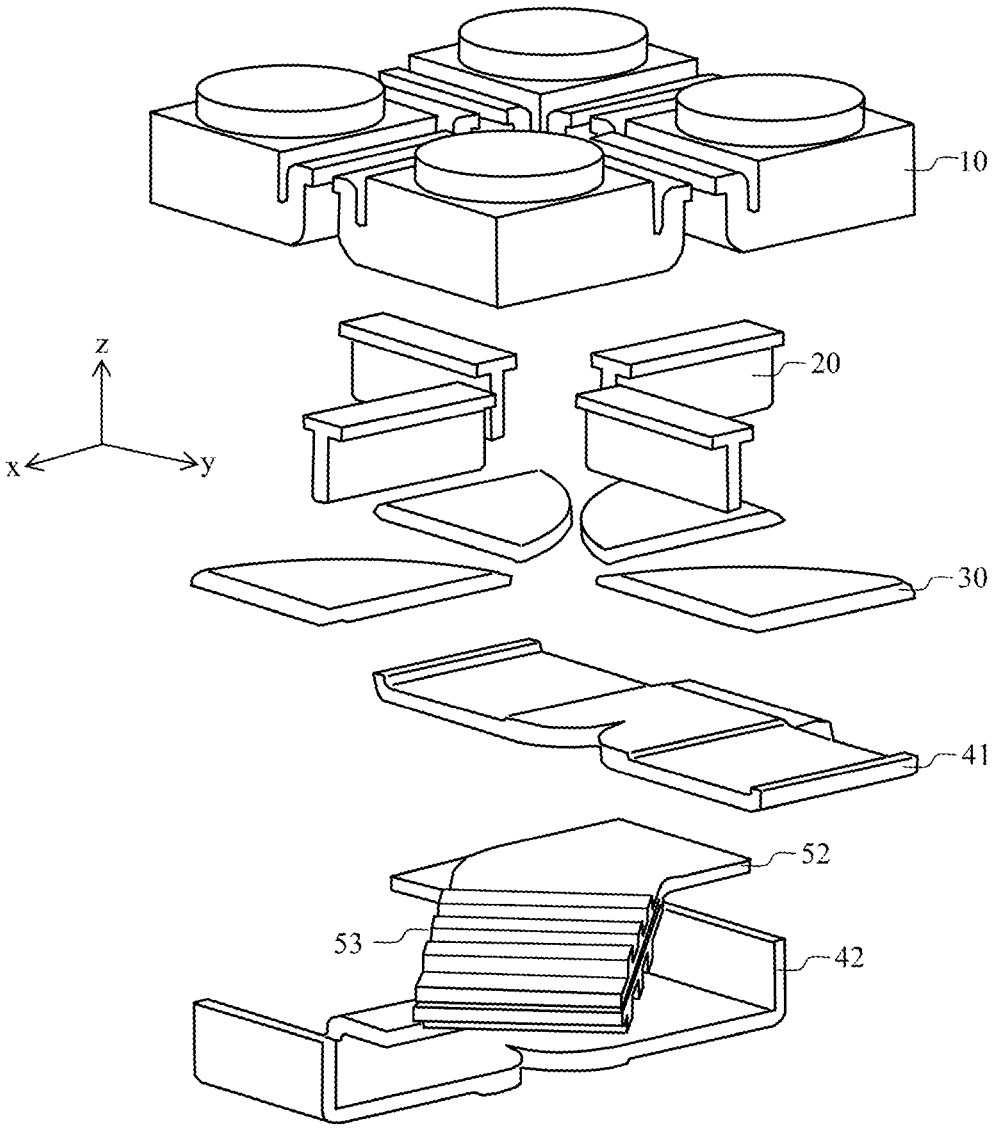
FIG. 9 shows an exploded three-dimensional view of a third configuration of a divider according to the invention.

FIG. 9 shows a third configuration of the divider according to the invention. In this configuration, the power divider according to the invention includes rejection filters 53, such that the emitted signal does not pollute the reception signal. These filters are in the shape of metal slots that are regularly spaced apart and positioned perpendicularly to the propagation of the signal.

The dividers according to the invention may operate in a frequency band of between 1 and 40 GHz, this corresponding to a useful wavelength of between 7.5 and 300 millimetres. More precisely, the frequency may belong to the transmission bands known as 'Ku-Tx' or 'Ka-Tx' that are intended for satellite transmissions. The Ku-Tx band is between 10.7 and 12.75 GHz, this corresponding to a useful wavelength of between 23 and 28 millimetres. The second Ka-Tx band is between 17.2 and 20.2 GHz, this corresponding to a useful wavelength of between 15 and 17 millimetres.

This type of divider may operate with high-power power sources. By way of example, the power of the power source may be greater than 60 watts.

Moreover, the geometry of the divider ensures very low returns on the emission source, generally lower than −20 dB, and very good isolation between the inputs of the top-wall coupler and the access points to the orthomode transducers. This isolation is greater than 20 dB.

The invention claimed is:

1. A compact bipolarization power divider for a dual orthogonal polarization radiofrequency power source emitting at a useful wavelength, said divider comprising four orthomode transducers, wherein the divider comprises:

eight identical waveguides, each waveguide comprising two bends and four identical T-shaped junctions, the four orthomode transducers all being identical and of substantially parallelepipedal shape with a square base, each of the transducers comprising a lower face and an upper emission face and four lateral faces, of the transducers comprising, on each of two adjacent lateral faces, one of the eight waveguides connected to the lower face of the transducer;

the four transducers being positioned so as to form a square, of the transducers being connected to two of the four junctions, these two junctions being perpendicular to one another, each of the junctions being connected by its two branches to the tops of two waveguides of the eight waveguides, the four identical T-shaped junctions forming a Greek cross centred on the square of the transducers.

2. The power divider according to claim 1, wherein the divider comprises four identical twists and two power distributors, each power distributor comprising a single input and two outputs, each pair of identical T-shaped junctions that are situated in one and the same plane being connected by a base of said identical T-shaped junctions, by way of two of the four identical twists, to two outputs of one of the two power distributors.

3. The power divider according to claim 2, wherein the divider comprises a coupler of which the input is intended to be linked to the radiofrequency power source and the two outputs of the coupler that are perpendicular to one another being linked to the two inputs of the two power distributors, said divider thus formed being able to generate circularly polarized signals.

4. The power divider according to claim 3, wherein the coupler is a top-wall coupler or a Riblet coupler.

5. The power divider according to claim 2, wherein each power distributor comprises an input, bent at 180 degrees, linked to two identical transverse branches, each of the branches being terminated by a 90-degree bend linked to an output, such that an input signal propagating in a given direction is separated into two identical output signals propagating in two directions that are parallel to one another and perpendicular to the given direction.

6. The power divider according to claim 2, wherein said divider comprises at least one rejection filter.

7. The power divider according to claim 1, wherein each of the twists comprises an enclosure in the shape of a flat quarter-cylinder, an input bent at 90 degrees and an output bent at 90 degrees, the two bends being positioned head to tail.

8. The power divider according to claim 1, wherein a side of the square base of each of the orthomode transducers are around 0.75 times the useful wavelength, and in that a height of each of the orthomode transducers is around 0.37 times the useful wavelength.

9. The power divider according to claim 1, wherein a side of the square base of the divider is around 2.24 times the useful wavelength, and in that a total height of the divider is around 0.8 times the useful wavelength.

10. The power divider according to claim 1, wherein a frequency associated with the useful wavelength is between 1 and 40 GHz.

11. The power divider according to claim 10, wherein a frequency associated with the useful wavelength is between 10.7 and 12.75 GHz or between 17.2 and 20.2 GHz.

* * * * *